United States Patent [19]

Vanderwoude

[11] 4,196,722

[45] Apr. 8, 1980

[54] PERCUSSION INSTRUMENT USED IN RESPIRATORY THERAPY

[76] Inventor: Carol A. Vanderwoude, 362 E. Ulskey Rd., Freeland, Wash. 98249

[21] Appl. No.: 1,299

[22] Filed: Jan. 5, 1979

[51] Int. Cl.[2] ..... A61H 31/00

[52] U.S. Cl. ..... 128/28; 128/38; 128/67

[58] Field of Search ..... 128/67, 60, 54, 28, 128/30, 38–40, 55

[56] References Cited

U.S. PATENT DOCUMENTS

| | | | |
|---|---|---|---|
| 624,545 | 5/1899 | Rosell | 128/38 |
| 713,761 | 11/1902 | Harlan | 128/38 |
| 1,201,767 | 10/1916 | Schimek et al. | 128/67 |
| 1,758,962 | 5/1930 | Miller | 128/38 |
| 1,882,040 | 10/1932 | Roehm | 128/38 |
| 2,054,849 | 9/1936 | Briggs | 128/54 |
| 2,067,268 | 1/1937 | Hans | 128/28 |
| 2,244,973 | 6/1941 | Swan | 128/28 |
| 2,264,422 | 12/1941 | Wells | 128/38 |
| 3,913,569 | 10/1975 | Kanonas | 128/67 |
| 3,955,563 | 5/1976 | Maione | 128/55 |

*Primary Examiner*—Lawrence W. Trapp

*Attorney, Agent, or Firm*—John R. Ley

[57] ABSTRACT

A hand-held, manually operated percussion instrument comprises a main body member formed of resilient material and incudes a sidewall portion and an end cap portion which are integrally connected and sealed together to define a continuous concave interior chamber. A base edge of the sidewall portion circumscribes an opening into the interior chamber. A sealing cuff of resilient and compressible material is attached to the base edge. A flattened interior end wall surface extends generally in parallel and planar spaced apart relation from a plane defined by the sealing cuff and base edge. In use, the percussion instrument is moved through the air with the concave interior chamber facing the chest wall of a human individual to whom respiratory therapy is applied. Upon contact with the chest wall, the sealing cuff compresses and seals against the chest wall. The interior chamber and the flattened interior end wall surface deliver air wave percussion into and through the chest wall at the termination of the stroke created by moving the percussion instrument through the air. The percussion instrument is withdrawn from the chest wall and the process is repeated.

8 Claims, 2 Drawing Figures

PERCUSSION INSTRUMENT USED IN RESPIRATORY THERAPY

BACKGROUND OF THE INVENTION

1. Field of the Invention

This invention relates to and is useful for respiratory therapy. More particularly, the present invention involves a percussion instrument which is repeatedly struck against or applied to the chest wall of a human individual for the purpose of delivering sound waves or percussion to the lung area. The percussion effects aid in loosening trapped secretions (characteristic of many chronic lung diseases such as asthma, cystric fibrosis, and emphysema), and in re-expanding collapsed airways (treating atelectasis). The technique is particularly useful to deliver percussion to the chest wall of premature infants and small children suffering from acute an chronic lung disorders, where atelectasis, trapped and/or excessive lung secretions are a problem. The technique is technically termed chest physiotherapy and is usually used in conjunction with postural drainage and vibration techniques.

2. Introduction and Brief Description of Prior Art

Historically, the first percussion devices used for respiratory therapy were the human hands. The hand of the therapist is cupped with the fingers and thumb closed to trap a pocket or cushion of air between the hand and chest wall as the cupped hand repeatedly struck the patient's bare chest. When properly executed, a clapping, hollow sound results and the percussion or sound vibrations are conducted deeply into the lung field. It is only with considerable experience and skill that the cupped hand technique is properly executed.

The cupped hand technique, if properly executed, is a reasonably satisfactory execution of respiratory therapy for adults. However, for small children, particularly premature infants whose weight may not exceed 1000 grams, the hand technique is inappropriate because the therapist's hands may be considerably larger than the infant's chest. Of course, with adults the therapist's hand is small in comparison with the chest wall.

To overcome the problem of improperly executing the cupped hand technique and the problem of applying respiratory therapy or chest physiotherapy to very small human individuals, various percussion instruments have been devised. One such device is a percussion hammer which employs a soft rubber cup at one end of an electrically driven reciprocating shaft. Percussion hammers avoid many of the problems in executing the cupped hand technique, but the heavy mechanical percussion hammers are too dangerous to use on infants and small children. Consequently hand-held, manually-operated percussion instruments are useful on infants and small children.

Most manually operated instruments have been makeshift in nature, and a new instrument had to be contrived for each instance of respiratory therapy. One example of a contrived percussion instrument is a small infant breathing mask which is oval in shape with cushions attached on the edges of the mask. Other examples are a small plastic medication cup or ear bulb syringe with an end cut off, both having tape wrapped around the edges.

Problems have resulted because of the makeshift nature of certain prior art percussion instruments. Generally the percussion instruments lack an adequate cushion to prevent injury to the skin as the instrument is repeatedly struck against the chest wall. Incidents of severe bruises and bleeding have been known to occur. Another problem is that most percussion instruments do not adequately seal against the chest wall. With an inadequate seal, the sound wave percussion effects are not propigated deep into the lung field, and effective chest physiotherapy is lost. A futher deficiency is that an interior chamber is not arranged for most effectively conducting the sound wave percussion deep into the lung area. The typical prior art configuration of the interior chamber often causes the sound waves to bounce between the walls of the interior chamber, thereby dissipating the energy effect of the waves instead of projecting the energy into the lung areas. Lastly, many prior art percussion instruments are not formed with an exterior configuration that can be readily grasped by the therapist. Without good control over the percussion instrument, which often occurs due to slippery surfaces and the like, the therapist cannot create a percussion effect at regular intervals. Consequently, effect of the therapy treatment is comprised. According to Eagan, *Fundamentals of Respiratory Therapy,* page 444, it is essential to the practice of chest percussion "to maintain a uniform blow throughout the entire procedure." The ability to adequately grip the percussion instrument to maintain uniform percussion effects at regular intervals is even more significant when very small percussion instruments are employed, since the small size of the percussion instrument is more difficult to grasp in the large hand of an adult.

Other disadvantages and limitations of the prior art are known. Those skilled in the art may recognize still further limitations and disadvantages in view of the desirable aspects to the present invention, but comprehension of the desirable aspects of this invention should not diminish the significance of many of the previous troublesome limitations in the prior art. Examples of prior art massage type devices are U.S. Pat. Nos. 728,003; 793,527; 915,251; 1,198,176; 1,201,767; and 2,078,536.

OBJECTS AND SUMMARY OF THE INVENTION

It is the general objective of this invention to provide a new and improved hand held percussion instrument useful for delivering percussion to the chest wall of a human individual during chest physiotherapy. Other objectives are to provide a new and useful percussion instrument which is adequately cushioned at a contact surface to prevent injury to the skin from use, which more completely and adequately seals for the percussion waves for delivery to the chest wall, which defines an interior chamber of proper configuration for effectively delivering the percussion waves directly and deeply through the chest wall into the lung area, and which is more conveniently and easily grasped and controlled during use.

The objectives are achieved by the present invention of a hand held percussion instrument which, in its broad aspects, includes a main body member formed of resilient material which includes a sidewall portion and an end cap portion sealed together to define a concave hollow interior chamber. The sidewall portion includes a base edge which circumscribes an opening into the interior chamber. The base edge generally extends in a plane and a flattened interior end wall surface of the end cap portion generally extends across the interior wall surface of the interior chamber in planar and parallel spaced apart relation with respect to a plane defined by the base edge. A sealing cuff of resilient and compressible material extends outward from and encompasses the base edge. The resiliency of the sealing cuff material is greater than the resiliency of the main body material. The sealing cuff defines a contact surface circumscribing the opening into the interior chamber when the percussion instrument contacts the chest wall. The resiliency of the sealing cuff cushions the skin against the blow delivered by the percussion instrument and seals with the chest wall for conducting the percussion waves into the lung area. The transverse extending interior end wall surface of the interior chamber reflects the percussion waves directly and deeply into the lung area. The exterior surface of the percussion instrument is formed with a plurality of outward projections which facilitate grasping by the therapist.

Other significant aspects, objectives, advantages and improvements appear in the following claims, description of preferred embodiment, and from the drawings described below.

DESCRIPTION OF PREFERRED EMBODIMENT

Figure 1:
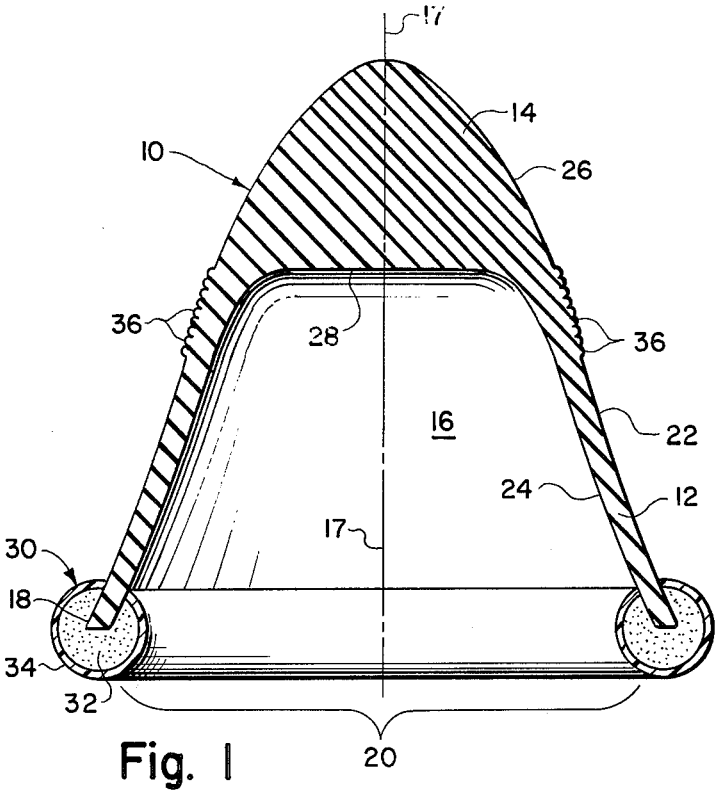
FIG. 1 is a vertical cross sectional view of a preferred embodiment of the percussion instrument of the present invention.

The hand operated percussion instrument for delivering percussion to the chest wall of the human being is illustrated in FIG. 1. The percussion instrument comprises a main body member 10 formed of resilient material such as rubber. The main body member 10 includes a sidewall portion 12 and an end cap portion 14 which are integrally connected and sealed together as the unitary main body member 10. The sidewall portion 12 and the end cap portion 14 cooperatively define a hollow continuous concave interior chamber 16. The main body 10 is preferably formed as a figure of rotation about an axis 17, and the percussion instrument in general is symmetrical about the axis 17. As used herein, the term "upward" or similar formatives or derivatives is a term employed relative to the orientation of the percussion instrument shown in FIG. 1, and is intended to mean in the direction of the axis 17 toward the top or end cap portion 14 from the bottom or lower sidewall portion 12. Terms such as "downward, lower" or similar formatives or derivatives mean the opposite of upward. The term "transverse" relates to a direction crosswise of the axis 17.

The sidewall portion 12 terminates at a lower base edge 18 which defines and circumscribes an opening 20 into the interior chamber 16. The size or diameter of the opening 20 varies according to the size of the percussion instrument. The base edge 18 is preferably smooth and continuous and lies in a plane essentially perpendicular to the axis 17. The sidewall portion 12 has an exterior surface 22 and a continuous interior wall surface 24. The interior wall surface 24 is spaced inwardly from the exterior wall surface 22 by the thickness of the main body member sidewall portion. The interior wall surface 24 converges inwardly toward the axis 17 and upwardly from the base edge 18. The surfaces 22 and 24 are preferrably concentric with the axis 17.

The end cap portion 14 includes an exterior surface 26 and a generally flat continuous interior end wall surface 28. The interior end wall surface 28 extends generally transversely across the interior chamber 16 from the interior wall surface 24 at its uppermost inwardly converged point. The exterior surface 26 smoothly continues the contour of the exterior surface 22 in an upwardly and inwardly converging manner, thereby defining a bell shaped exterior configuration of the instrument.

The interior end wall surface 28 extends approximately in parallel planar and spaced apart relation with respect to the plane defined by the base edge 18. The upward distance or height between the plane defined by the base edge 18 and the interior end wall surface 28 varies according to the size of the percussion instrument. The interior wall surface 24 and the interior end wall surface 28 define a continuous interior chamber 16, that is an interior chamber free of breaks or openings, except at the main opening 20.

A sealing cuff 30 is attached to and surrounds the base edge 18. The sealing cuff is formed of resilient and compressible material 32 such as foam and is attached to the base edge 18 and the lowermost portions of the exterior and interior surfaces 22 and 24 of the sidewall portion by gluing, for example. Attached in this manner, the sealing cuff 30 also circumscribes the opening 20 to the interior chamber 16. The cuff material 32 extends substantially outward from the base edge and may assume a generally circular cross sectional shape as shown in FIG. 1. Other cross sectional configurations may be satisfactorily employed, but the cuff material should be of sufficient thickness, i.e. transverse width and vertical height, to compress sufficiently to cushion the blow to the chest wall. The thickness of the sealing cuff varies according to the size of the percussion instrument. Preferably, a cover 34 of soft pliable plastic material is attached to the cuff material 32 of the sealing cuff such as by gluing. The cover 34 forms a smooth enclosure for the cuff material so that, among other things, the instrument can be readily cleaned after each use.

Figure 2:
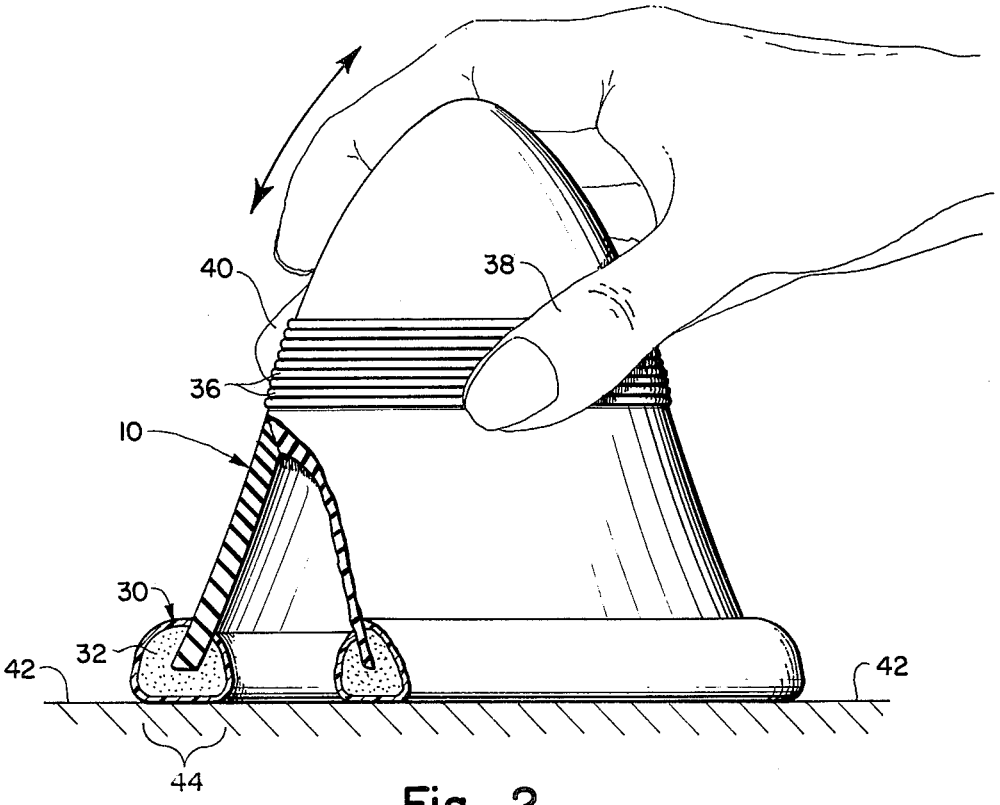
FIG. 2 is a side elevational view of the percussion instrument illustrating the manner in which it is grasped in the hand of the therapist and the manner in which it is applied against the chest walls of the human individual, with a portion broken out to disclose the compressed nature of the sealing cuff during contact with the chest wall.

A plurality of projections 36 extend outward from the exterior surface 22 of the sidewall portion 12. The projections 36 are adapted to facilitate gripping of the percussion instrument between the thumb 38 and forefinger 40 of the therapist, as is illustrated in FIG. 2. The projections 36 may take a variety of different forms: a plurality of concentric rings extending in planes perpendicular to the axis 17 of the instrument (shown in FIGS. 1 and 2), a plurality of ridges extending parallel to the axis 17 of the instrument, or a plurality of random dot-like projections.

In use, as is illustrated generally in FIG. 2, the percussion instrument is grasped with the projections 36 between the thumb 38 and forefinger 40 of the therapist. The instrument is oriented so that the opening 20 and concave interior chamber 16 face the chest wall 42 of the human individual. The instrument is further oriented so that the sealing cuff 30 will contact the chest wall 42 approximately simultaneously along its whole contact surface 44 when the percussion instrument is struck against the chest wall 42. By contacting the whole contact surface 44 of the sealing cuff 30 with the chest walls approximately simultaneously, a seal is created between the interior chamber 16 and the chest wall, thus conducting the percussion waves directly into the lung areas beneath the chest wall 42.

Once properly oriented in the therapist's hand the instrument is moved through the air in a stroke and contact with the chest wall 42 occurs. Upon contact, the compressible resilient characteristics of the cuff material 32 create the contact surface 44, and the contact surface is greater in transverse width than the transverse distance between the interior and exterior surfaces 22 and 24 of the sidewall portion 12 at a point adjacent the base edge 18, as is illustrated in FIG. 2. The increased width of the contact surface 44 assures a more complete seal of the interior chamber 16 to the chest wall than can be obtained by the base edge 18 by itself or by use of a non-compressible body as is typical in the prior art. The resilient and compressible characteristics of the cuff material 32 cushion the blow more effectively than percussion instruments without a compressible sealing cuff 30. The compressible characteristics of the foam material 32 absorb some of the energy as the instrument is brought to bear against the skin, and the expanded or increased width of contact surface 44 distributes the energy of the blow over a larger area than is possible with percussion instruments having uniform thickness sidewalls. The increased width of the contact surface 44 reduces the chance of creating bruising or bleeding due to localized and concentrated energy effects upon limited surface areas of the skin.

The compressible, resilient and deformable characteristics of the cuff material 32 also assure a better seal against the chest wall than is possible from less resilient material, such as that from which the main body member 10 is formed. The sealing cuff 30 readily conforms to the curvature of the chest wall, thus creating a good seal. The thickness and outward extent of the cuff material from the less resilient base edge allows for sufficient deformation to achieve the seal over curved chest walls.

The arrangement and configuration of the interior chamber ly conducts and directly propigates the percussion waves into the chest wall 42 and deeply into the lung areas. The flattened transversely extending interior end wall surface 28 is generally parallel to the chest wall 42 during contact, because the interior end wall surface 28 is generally parallel to the plane defined by the base edge 18 and the base edge is in close adjacency to the chest wall. Interior end wall surface 28 reflects and bounces the percussion waves directly onto the chest walls, in contrast to certain prior art devices which reflect the percussion waves off of the sidewalls of the interior chamber and thereby dissipate wave energy before the percussion waves enter the lung areas. The slightly converging configuration of the interior wall surface 24 does not unnecessarily dissipate the wave energy because the wall surface 24 approaches an angle parallel with the axis 17. As a result of the angular relationship between the interior wall surfaces 24 and 28, any percussion waves incident on the sidewall surfaces 24 are reflected at a very low angle, thereby directing those sound waves directly and deeply into the chest wall. The effectiveness of the percussion waves delivered to the lung areas is increased, and the amount of treatment required is reduced. The reduction in treatment reduces the possibility for injury to the skin.

The projections 36 formed on the exterior surface 22 allow the therapist to readily grasp the instrument and more properly control its use. Good control of the instrument is particularly important as the therapist contacts substantially the whole contact surface 44 of the sealing cuff 30 with the chest wall 42 approximately simultaneously to creat the seal with the interior chamber 16. After contact with the chest wall the instrument is withdrawn. The described process is repeated for each percussion blow delivered.

Four different sizes of percussion instruments are proposed to enable the therapist to choose an appropriate size instrument for use with different sized infants. The first size percussion instrument is intended for use on infants which are typically premature and weigh from 600 grams to 1,000 grams (2.2 pounds). In the first size of instrument, the opening 20 defined by the base edge 18 is approximately one inch in diameter; the vertical height from the plane defined by the base edge 18 to the interior end wall surface 28 is approximately in the range of one and one-fourth to one and one-half inches; and the thickness of the sealing cuff is in the range of approximately one-fourth to three-eighths inch. The second size of percussion instrument is intended for use on infants weighing from one pound to twelve pounds. In the second size of instrument, the diameter of the opening 20 is approximately one and one-half inches; the vertical height from the base edge 18 to the interior end wall surface 28 is in the range of one and one-fourth to one and one-half inch; and the thickness of the sealing cuff is in the range of three-eighths to one-half inch. The third size of percussion instrument is intended for use on infants weighing from twelve pounds to eighteen pounds. In the third size of instrument, the diameter of the opening 20 is approximately two inches; the vertical height from the base edge 18 to the interior end wall surface 28 is in the range of one and one-eighths to one and five-eighths inches; and the thickness of the sealing cuff is in the range of three-eighths to five-eighths inches. The fourth size of percussion instrument is intended for use on infants from eighteen to twenty-four pounds. In the fourth size of instrument, the diameter of the opening 20 is approximately two and one-half inches; the vertical height from the base edge 18 to the interior end wall surface 28 is in the range of two to two and one-half inches; and the thickness of the sealing cuff is approximately three-fourths inch.

The preferred embodiment of the present invention has been described with a degree of particularity, as have been its the significant advantages, objectives and features. It should be understood, however, that the degree of specificity is not intended to restrict the spirit and scope of the invention or the definition thereof in the appended claims.

I claim as my invention:

1. A hand-held, manually operated percussion instrument for use in delivering percussion to the chest wall of a human individual during respiratory therapy, comprising:

a main body member formed of resilient material and including a sidewall portion and an end cap portion, the sidewall and end cap portions being integrally connected and sealed together to define an interior chamber within the main body member;

the sidewall portion terminating at a lower base edge which circumscribes an opening into the interior chamber, the base edge generally extending within a plane;

the sidewall portion including an exterior surface and a continuous interior wall surface, the interior wall surface being spaced in relation to the exterior surface, the interior wall surface extending upwardly from the base edge;

the end cap portion including a generally flattened continuous interior end wall surface and an exterior surface, the interior end wall surface extending generally transversely across the interior wall surface of the sidewall portion, the interior end wall surface also extending generally in parallel and spaced apart planar relation with respect to the plane defined by the base edge;

the interior wall surface of the sidewall portion and the interior end wall surface of the end cap portion thereby defining a continuous interior chamber extending concavely into the main body member from the opening circumscribed by the base edge; and a sealing cuff of resilient and compressible material attached to and extending outwardly from the base edge, the sealing cuff thereby also circumscribing the opening into the interior chamber, the material of the sealing cuff being more resilient than the material of the main body member, the sealing cuff defining a contact surface adapted for contacting and sealing against the chest wall of the human individual during use, the transverse width of the contact surface when in contact with the chest wall being generally greater than the transverse width between the interior wall surface and the exterior surface of the sidewall portion at the base edge.

2. A percussion instrument as defined in claim 1 further comprising a cover of soft pliable material substantially covering the resilient material of an exterior surface of the sealing cuff.

3. A percussion instrument as defined in claim 2 wherein the interior wall surface of the sidewall portion converges inwardly and upwardly from the base edge.

4. A percussion instrument as defined in claim 3 wherein the exterior surface of the sidewall portion includes a plurality of projections extending therefrom, the projections being adapted to be gripped during use.

5. A percussion instrument as defined in claim 4 wherein the instrument is generally concentric about an upward extending axis therethrough.

6. A percussion instrument as defined in claim 5 wherein the exterior surfaces of the sidewall and end cap portions define a generally bell shaped exterior configuration.

7. A method utilizing the percussion instrument as defined in claim 1, for delivering percussion to the chest wall of the human individual, comprising:

gripping at least one of the exterior surfaces of said percussion instrument, moving the percussion instrument through the air with the concave interior chamber facing the chest wall of the human individual, contacting substantially the whole of the contact surface of the sealing cuff with the chest wall approximately simultaneously, and withdrawing the percussion instrument from the chest wall after contact.

8. A method as defined in claim 7 further comprising:

repeating the aforesaid steps of moving, contacting and withdrawing.

* * * * *